United States Patent [19]

Brugner

[11] 4,095,977

[45] * Jun. 20, 1978

[54] MATERIAL FOR MAKING ELECTRICAL CONTACTS, PROCESS FOR MAKING MATERIALS, AND CONTACTS MADE WITH THE MATERIAL

[75] Inventor: Jr. Brugner, Fox Point, Wis.

[73] Assignee: Square D Company, Park Ridge, Ill.

[ * ] Notice: The portion of the term of this patent subsequent to Mar. 8, 1994, has been disclaimed.

[21] Appl. No.: 714,068

[22] Filed: Aug. 13, 1976

[51] Int. Cl.[2] ..... B22F 3/00

[52] U.S. Cl. ..... 75/234; 75/235; 200/266

[58] Field of Search ..... 29/182.5; 75/200, 211, 75/206, 234, 235; 200/266; 148/126

[56] References Cited

U.S. PATENT DOCUMENTS

| | | | |
|---|---|---|---|
| 1,872,065 | 8/1932 | Duffendack et al. | 75/170 |
| 3,930,849 | 1/1976 | Krock | 29/182.5 |
| 4,011,052 | 3/1977 | Davies | 75/206 |

FOREIGN PATENT DOCUMENTS 2,341,730 3/1974 Germany.

OTHER PUBLICATIONS

Bradwarow, Proceedings of Fifth International Conference on Electric Contact Phenomena, May 1970.

*Primary Examiner*—Brooks H. Hunt
*Attorney, Agent, or Firm*—W. H. Schmeling; H. J. Rathbun; R. J. Falkowski

[57] ABSTRACT

A material for use in making electrical contacts is produced in a powder form suitable for later processing into electrical contacts by standard metallurgical techniques generally involving compacting, sintering, and forming or cutting to make the desired contact size and shape. The material, and in most general applications the contact made from the material, essentially consists of silver, approximately 15% cadmium oxide by weight, and lithium oxide at a proportion of about .005 weight percent of lithium, which is approximately equal to .04 molecular percent of lithium oxide. The lithium oxide is added and uniformly distributed on the surfaces of the powder particles by precipitation.

42 Claims, 1 Drawing Figure

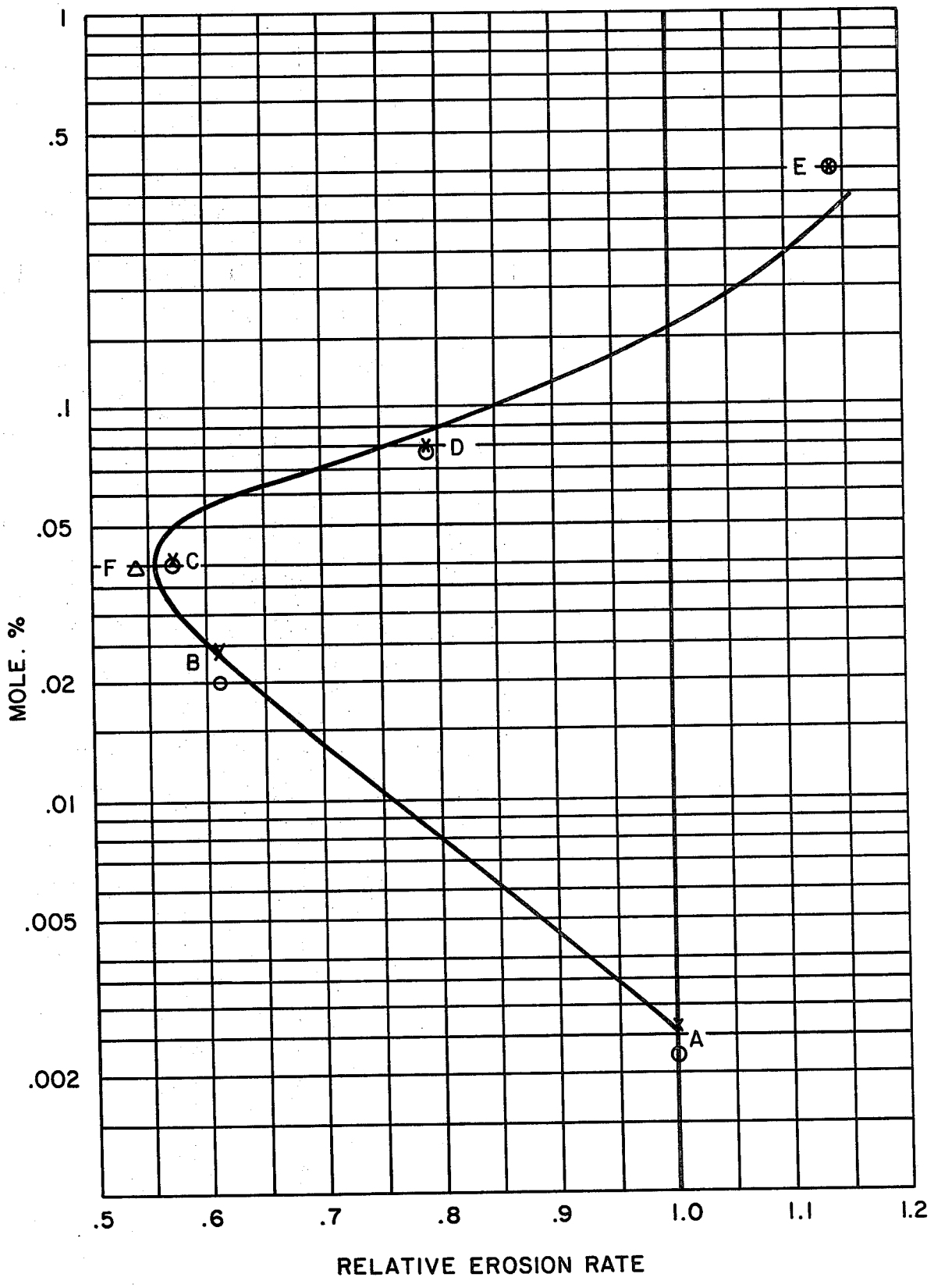
1
.5
.1
.05
.02
.01
.005
.002
MOLE. %
E
D
C
F
B
A
.5
.6
.7
.8
.9
1.0
1.1
1.2
RELATIVE EROSION RATE

MATERIAL FOR MAKING ELECTRICAL CONTACTS, PROCESS FOR MAKING MATERIALS, AND CONTACTS MADE WITH THE MATERIAL

This invention relates to materials for use in making electrical contacts for medium and low power electrical equipment, to processes for making the materials, and to contacts made from the material.

It is well known in the prior art to make electrical contacts from a conductive material and an added material that provides embrittlement qualities to the contact. Typically, silver and cadmium oxide mixtures are used for most medium and low alternating electrical power switching applications. Recently such electrical contacts have been improved, particularly with respect to erosion rate, by the addition of a third material having a low electronic work function, such as lithium preferably in the form of lithium oxide. The low electronic work function material include the alkali and alkaline metals, group 1A and 2A in an appropriate periodic table, and most of their oxides. The oxides are preferably added in a powder process by precipitation or similar techniques to produce uniform distribution of the third material on the surface of the powder particles.

The prior art generally teaches that the addition of the third metal oxide should be in moderate but significant weight percentages for maximum improvement because the improvement effect is expected to be enhanced in some direct relationship to percentage levels added. Thus, it has been generally accepted that for a silver and cadmium oxide mixture, typically silver with 15% cadmium oxide, a percentage in the range of about one to three percent of lithium by weight in the total mixture added either as lithium or lithium oxide would produce the maximum beneficial results with respect to erosion qualities.

However, with this invention a material is produced that has vastly superior erosion characteristics and produces these characteristics by adding an unexpectedly low amount of the low electronic function material to achieve a maximum benefit. It has been established that maximum resistance to erosion can be obtained by carefully selecting the percentage of low electronic work function material to be significantly below that which has been expected in the prior art.

The objects and other advantages of this invention will appear from the following description.

FIG. 1 is a curve showing test results of erosion characteristics on linear-logarithmic coordinates.

In accordance with this invention material for use in making electrical contacts is produced by standard metallurgical or other suitable techniques. Since it is known that silver is a preferred metal and cadmium oxide is a preferred high percentage additive, materials selected for tests comprised 85% silver and 15% cadmium oxide by weight. This material is known to produce good contacts and was produced with a powder process. While any process using the same basic constituents would produce improved results, the prior art indicates that material made by a powder process using an internal oxidizing procedure would produce the greatest improvement.

To produce contacts according to the invention, a powder is made by mixing a first and second starting material in the desired proportions. The first starting material is silver powder obtained by sieving through a 40 micron screen to produce an average particle size of about twenty microns or less in diameter. The second starting material is cadmium oxide powder in the size range of 0.01 to 2 microns in diameter. The two powders are dry tumble mixed in a drum and the finally mixed powders are sieved through a forty micron screen.

The sieved powder is heated in a highly reducing atmosphere of hydrogen to convert the cadmium oxide to cadmium by placing it in a furnace at a temperature of about 200 to 700° C spread to a depth of about one centimeter. The temperature is kept below the melting temperature of the resulting alloy that would be produced by the proportion of silver and cadmium present to prevent forming of a melt and alloying occurs as the cadmium dissolves or diffuses into the silver particles.

The resulting alloyed material is mechanically broken down and sieved through a 500 micron screen to produce an alloy in a powder or particle form. The sieved alloy powder is then heated in an oxidizing atmosphere at a temperature low enough to prevent the forming of a melt and high enough to assure complete internal oxidation. The material is then sieved to a degree of fineness appropriate for making contacts as known.

A third starting material, which is selected to eventually provide an additive material, an oxide of an alkali or alkaline metal essentially, but preferably an oxide of lithium or barium, is added after the sieving and oxidation step. The third starting material, which can be any compound of a low work function metal reducible to an oxide form, is dissolved in a suitable solvent which is mixed with the oxidized alloy to form a slurry. Percentages are selected to reach the desired end result and the slurry is dried to produce an internally oxidized silver-cadmium alloy powder with small crystals of the compound of the low work function material formed on the surface of the powder particles. The dry powder mixture is then sieved through a suitably sized screen to break up any large cakes of material formed and is then decomposed to its oxide form by heating as necessary. The resulting powder material then consists of an internally oxidized silver-cadmium oxide alloy powder with oxide particles uniformly dispersed over the surfaces. This material is sieved through a screen to produce a size desired for processing to make contacts.

The contacts are processed by typical metallurgical techniques involving compressing the material to form a compact body, sintering the body, and coining the sintered body for the final shape and size required for the contacts.

Contacts fabricated by this process were tested for relative erosion occurring after 250,000 switching operations. The tests were conducted on a NEMA size 3 contactor at 300 operations per hour. The conditions for closing the contact were 575 volts alternating current at 750 amperes with a 3 phase, 60 hertz source and a load having a power factor of 0.35 and the opening was made at 95 volts alternating current, 125 amperes with the same source and power factor. The results are shown in the following table and are plotted in FIG. 1 which has the molecular percent of lithium oxide, or its converted equivalent, in the total mixture plotted along the vertical logarithmic axis and the relative erosion rate plotted along the horizontal linear axis.

| Material | Li Weight % | $Li_2O$ Molecular % | 1A, 2A Molecular % | Relative Erosion |
|---|---|---|---|---|
| A | .0003 | .0024 | .0032 | 1.00 |
| B | .0025 | .020 | .028 | .61 |
| C | .0050 | .040 | .041 | .57 |
| D | .0100 | .078 | .080 | .79 |
| E | .0500 | .400 | .40 | 1.14 |
| F | — | .039* | .039 | .54 |

*BaO

The erosion rate of contacts substantially without lithium oxide was selected for comparison purposes as plotted at point A for test A. As shown, the lithium weight percent was determined to be 0.0003, which is 0.0024 molecular percent of lithium oxide, which is plotted as a "circle." Additional impurities of low electronic work function material present raised the total equivalent molecular percent to 0.0032 which is plotted as an "X." The other materials had lithium oxide added as shown in the table and were tested to determine the impurity levels of other low electronic work function materials and the results are plotted as a "circle" and an "X," respectively, as shown in FIG. 1. Test F plotted as a "triangle" at point F, was conducted using barium oxide.

For comparison purposes it was determined that the standard relative erosion rate for a material made by standard processing, i.e., other than powder processing, having 85% silver and 15% cadmium oxide by weight is about 1.2 as compared to the erosion rate of an equivalent powder process material, which is 1.0 (Point A).

Material B contained 0.0025 weight percent of lithium, which is equivalent to 0.02 molecular percent of lithium oxide, and a total amount of low electronic work function of 0.028 equivalent molecular percent. The relative erosion rate of this was 61% of that of the silver, cadmium oxide material A.

Materials C, D and E were added with the results shown.

Material F contained 0.039 molecular percent of barium oxide with a relative erosion rate of about 0.54 of that of material A.

The conclusion from this series of tests and other verifying data indicates that, contrary to that which would be expected from the prior art, the amount of lithium oxide that should be added to silver, cadmium oxide material is much smaller than one to three weight percent. The maximum advantage is obtained if the molecular percent of lithium oxide, or other low electronic work function material, is held within the range of 0.01 to 0.1 or preferably in the range of 0.015 to 0.08 with the maximum benefit occurring at about 0.03 to 0.05 molecular percent. However, it is apparent that some improvement occurs with any significant or measurable effective amount up to a maximum of about 0.2 molecular percent which is about 0.03 weight percent of lithium.

The data using barium substantiates the theory that any of the low electronic work function materials from either group 1A, which includes lithium, sodium, potassium, rubidium, and cesium, or group 2A, which includes barium, beryllium, magnesium, calcium, strontium, and radium would produce the same improvement. Because of safety considerations beryllium and radium are considered unsuitable. Also with respect to the materials used there is substantiation in the prior art that with any conducting primary material such as silver or copper and the addition of any embrittling material such as cadmium oxide, tin oxide or zinc oxide, the addition of the low electronic work function materials would have substantially the same results with appropriate adjustments that could be readily made by anyone skilled in the art having the knowledge of this invention.

The addition of the second embrittling metal to the first conducting metal can be achieved by adding it from a minimum effective amount up to the maximum of solubility of the second metal in the first metal. Within this range the second metal can then be internally oxidized in any suitable way and an oxide of the third low electronic work function material can be added within the range percentages indicated in accordance with this invention.

While the contacts may be made in any number of ways, the powder process has been shown to produce the best results and would be preferred for most applications falling within the range suggested by the test data and particularly for high level make, low level break switching applications. To produce contact material in this manner, the process entails starting with a mixture of a first metal and a second metal added to the first metal to alloy with the first metal and is added in an amount up to the limits of solubility of the second metal in the first metal. The mixed material is alloyed in powder form and the powder is heated in an oxidizing atmosphere to oxidize the second metal in a manner that internally oxidizes the second metal. The third metal or its oxide is added in any known manner, such as by precipitation, so that it is evenly dispersed throughout the powder.

Specifically with silver and cadmium oxide a desirable proportion of cadmium in the prior art is about thirteen percent cadmium by weight in the total material mixture. Thus it appears that a mixture of about ten percent to twenty percent of cadmium oxide with the rest silver is preferred for addition of the third metal oxide. It may be appropriate to increase the amount of cadmium for some applications since cadmium can theoretically be dissolved up to forty percent by weight to sixty percent silver at room temperature and this can be increased to 44% at 400° C. With other metals that are suitable, it is necessary, in order to obtain internal oxidation of the second metal during typical processing that the second metal oxidize more readily then the first metal under the processing conditions to be encountered or selected.

Whichever starting metals are used the resulting material is then compacted to the desired density, sintered to produce the desired structure for use in the contact, and finally formed into the end contact desired by cutting or other techniques. The contact may then be added to the physical switching contact apparatus in any manner known in the art.

To understand the operation of a low electronic work function material one theory that explains performance requires the uniform distribution of the low work function material on the finished electrical contact. When a contact consists of substances of similar electronic work functions, erosion is caused by the discharge from contact operation that occurs between those points that protrude most out of the contact surfaces. As the contact operates and the discharge is initiated, electrons are emitted from these protrusions and the electric field in the vicinity of the protrusions is distorted and increased to a level that significantly increases the emission of electrons. This creates a particular and probable path for the arc discharge. Each arc damages and roughens the contact surfaces in the region where it occurs thereby producing high protrusions in that region and this increases the probability that subsequent discharge areas will occur in the same region. This causes excessive erosion or excessive contact material transfer in the same, limited areas.

If the low electronic work function material is distributed evenly throughout the contact surface in accordance with this invention the erosion is significantly reduced apparently because it is evenly distributed. The apparent explanation is that the evenly distributed low electronic work function material provides an alternate mechanism for initiating arc discharge since electrons are emitted far more easily, i.e., at lower electric field strength, by the lower electronic work function material than by the other, higher work function, materials. The sites of the low electronic work function material in the contact act in generally the same manner with regard to electron emission as do the protrusions in the usual contact. The highest protrusion that contains low work function material provides the electrons that initiate the arc discharge and the resulting discharge destroys the original shape of the protrusion and roughens the area surrounding it at a reduced level because of the reduced current density. The discharge also removes the low electronic work function material from the region and, therefore, the next discharge is more likely to be initiated by the highest protrusion that contains low work function material and so on. Hence, since the low work function materials are distributed throughout the contact, erosion is well spread over the contact surfaces.

Other explanations of the mechanism by which the contact performs as desired are known and seem to contribute to explaining other observed phenomena. It also seems to be true that with the low electronic work function materials the current density of the arcs formed is reduced which reduces the amount of material destroyed by each specific arc. Since the low work function materials also seem to have high first ionization potentials this characteristic would seem to help explain the improvements observed.

Another improvement established, which is supported by the explanation, is the effectiveness of the oxides of the alkali and alkaline metals. The oxides in addition to having low electronic work functions generally have first ionization potentials in comparison to their metals. Thus the oxides in addition to being more easily handled and processed and having low electronic work functions also have a higher ionization potential with its resulting advantages.

Also the two phenomena may explain other resulting erosion characteristics since the oxides decompose at different temperatures but generally in the range of temperatures that occur in arcs. Such decomposition would lower the ionization potential and the electronic work function from that of the oxide to that of the metal and would explain the varying improvements with different combinations.

The total benefit in erosion characteristics would accordingly be determined from a comparison of the electronic work of the metal and its oxide, the ionization potential of the metal and its oxide, the temperature at which the oxide decomposes into the metal and oxygen, and the temperature and duration of the arcs encountered. To the degree that factors can be ascertained contacts can be designed to accomplish the most beneficial results for particular applications using the teachings of this invention. This assumes that these theories do in fact explain the benefits obtained in using contacts made according to this invention. The evidence seems to indicate this but it has not been conclusively established and the improvements with this invention may in part result from phenomena not known or not understood.

I claim:

1. A contact material in powder form for use in making electrical contacts for power level applications consisting essentially of a first metal selected to have a relatively high electrical conductivity, an oxide of a second metal selected to impart desired qualities to the material added in an amount from a minimum effective amount up to a maximum equal to the limit of solubility of the second metal in the first metal, and an additive material in oxide form selected to have a low electronic work function added in an amount of from about 0.01 to about 0.78 molecular percent of the total contact material with said oxides of the first and second metals uniformly distributed throughout the material.

2. A contact material according to claim 1 wherein the additive material is added in an amount of about 0.03 to about 0.05 molecular percent of the total contact material.

3. A contact material according to claim 2 wherein the first metal is silver.

4. A contact material according to claim 2 wherein the additive material is lithium oxide.

5. A contact material according to claim 2 wherein the additive material is barium oxide.

6. A contact material according to claim 3 wherein the oxide of the second metal is cadmium oxide.

7. A contact material according to claim 6 wherein the additive material is lithium oxide.

8. A contact material according to claim 6 wherein the additive material is barium oxide.

9. A contact material according to claim 1 wherein the first metal is silver.

10. A contact material according to claim 9 wherein the additive material is barium oxide.

11. A contact material according to claim 9 wherein the additive material is lithium oxide.

12. A contact material according to claim 9 wherein the oxide of the second metal is cadmium oxide.

13. A contact material according to claim 12 wherein the additive material is an oxide of a metal selected from the group consisting of lithium, sodium and, rubidium.

14. A contact material according to claim 12 wherein the additive material is an oxide of a metal selected from a group consisting of, calcium, strontium, and barium.

15. A contact material according to claim 1 wherein the additive material is an oxide of a metal selected from a group consisting of lithium, sodium, and, rubidium.

16. A contact material according to claim 1 wherein the additive material is an oxide of a metal selected from a group consisting of, calcium, strontium and barium.

17. A contact material according to claim 1 wherein the additive material is lithium oxide.

18. A contact material according to claim 1 wherein the additive material is barium oxide.

19. A contact material according to claim 1 wherein the oxide of the second metal is cadmium oxide.

20. A contact material according to claim 19 wherein the additive material is an oxide of a metal selected from a group consisting of lithium, sodium and, rubidium.

21. A contact material according to claim 19 wherein the additive material is an oxide of a metal selected from a group consisting of, calcium, strontium and barium.

22. A sintered electrical contact for use in electrical contactors for power level applications comprising a first metal selected to have a relatively high electrical conductivity, an oxide of a second metal selected to impart desired embrittlement qualities to the contact added in an amount from a minimum effective amount up to a maximum equal to the limit of solubility of the second metal in the first metal, and an additive material in oxide form selected to have a low electronic work function and added in the approximate range of from 0.01 to 0.078 molecular percent of the total of the first metal, the oxide of the second metal and the additive material with said oxides of the first and second metals uniformly distributed throughout the material.

23. An electrical contact according to claim 22 wherein the additive material is added in the range of 0.03 to 0.05 molecular percent.

24. An electrical contact according to claim 23 wherein the first metal is silver.

25. An electrical contact according to claim 24 wherein the additive material is lithium oxide.

26. An electrical contact according to claim 24 wherein the additive material is barium oxide.

27. An electrical contact according to claim 24 wherein the oxide of the second metal is cadmium oxide.

28. An electrical contact according to claim 27 wherein the additive material is lithium oxide.

29. An electrical contact according to claim 27 wherein the additive material is barium oxide.

30. An electrical contact according to claim 22 wherein the first metal is silver.

31. An electrical contact according to claim 30 wherein the additive material is barium oxide.

32. An electrical contact according to claim 30 wherein the additive material is lithium oxide.

33. An electrical contact according to claim 30 wherein the oxide of the second metal is cadmium oxide.

34. An electrical contact according to claim 33 wherein the additive material is the oxide of a metal selected from a group consisting of lithium, sodium, and, rubidium.

35. An electrical contact according to claim 33 wherein the additive material is the oxide of a metal selected from a group consisting of, calcium, strontium and barium.

36. An electrical contact according to claim 22 wherein the additive material is an oxide of a metal selected from the group consisting of lithium, sodium, and, rubidium.

37. An electrical contact according to claim 22 wherein the additive material is an oxide of a metal selected from a group consisting of, calcium, strontium and barium.

38. An electrical contact according to claim 22 wherein the additive material is lithium oxide.

39. An electrical contact according to claim 22 wherein the third material is barium oxide.

40. An electrical contact according to claim 22 wherein the oxide of the second metal is cadmium oxide.

41. An electrical contact according to claim 40 wherein the additive material is the oxide of a metal selected from a group consisting of lithium, sodium, and, rubidium.

42. An electrical contact according to claim 40 wherein the additive material is the oxide of a metal selected from a group consisting of, calcium, strontium and barium.

* * * * *

UNITED STATES PATENT AND TRADEMARK OFFICE

CERTIFICATE OF CORRECTION

PATENT NO. : 4,095,977

DATED : June 20, 1978

INVENTOR(S) : Frank S. Brugner, Jr.

It is certified that error appears in the above-identified patent and that said Letters Patent are hereby corrected as shown below:

Inventor's name incorrect - should be Frank S. Brugner, Jr.
Fox Point, Wis.

Column 6, Line 20 Delete "0.78", insert -- .078 --

Signed and Sealed this

*Third* Day of *July 1979*

[SEAL]

*Attest:*

*Attesting Officer*

LUTRELLE F. PARKER

*Acting Commissioner of Patents and Trademarks*